US006620566B1

(12) United States Patent
Yamauchi

(10) Patent No.: US 6,620,566 B1
(45) Date of Patent: Sep. 16, 2003

(54) IMAGE FORMING APPARATUS AND IMAGE FORMING METHOD

(75) Inventor: Toshiaki Yamauchi, Fujisawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/660,458

(22) Filed: Sep. 12, 2000

(30) Foreign Application Priority Data

Oct. 22, 1999 (JP) ..... 11-301399

(51) Int. Cl.[7] ..... G03G 13/01; G03G 15/01

(52) U.S. Cl. ..... 430/45; 430/107.1; 399/223; 399/299

(58) Field of Search ..... 430/45, 47, 107.1, 430/108.3, 106, 45.47, 108.4; 399/223, 299

(56) References Cited

U.S. PATENT DOCUMENTS 5,843,605 A 12/1998 Anno et al. ..... 430/45
6,127,081 A * 10/2000 Yamauchi ..... 430/108.3
6,136,491 A * 10/2000 Yamauchi ..... 430/108.3
6,160,142 A * 12/2000 Sawada et al. ..... 430/108.4
6,192,207 B1 * 2/2001 Yamamoto et al. ..... 399/299
6,218,065 B1 * 4/2001 Tanikawa et al. ..... 430/108.3
6,333,132 B1 * 12/2001 Tomura ..... 430/45

OTHER PUBLICATIONS

Diamond, A.S. ed. *Handbook of Imaging Materials*, Marcel Dekker, Inc., NY (1991), p. 169, 1991.*

* cited by examiner

*Primary Examiner*—Janis L. Dote
(74) *Attorney, Agent, or Firm*—Foley & Lardner

(57) ABSTRACT

Full-color developing agents using a polyester resin having a pre-determined acid value as a binder, a zirconium complex of a salicylic acid derivative as a CCA, a benzimidazolone as a yellow pigment, a naphthol AS insoluble azo pigment as a magenta pigment, a phthalocyanine pigment as a cyan pigment, and carbon black as a black pigment are applied to obtain high-quality images having stable charging characteristics, good color tones, satisfactory image density, and no problems in fog and toner scattering.

8 Claims, 1 Drawing Sheet

IMAGE FORMING APPARATUS AND IMAGE FORMING METHOD

CROSS-REFERENCE TO RELATED APPLICATIONS

This application is based upon and claims the benefit of priority from the prior Japanese Patent Application No. 11-301399, Oct. 22, 1999, the entire contents of which are incorporated herein by reference.

BACKGROUND OF THE INVENTION

The present invention relates to a color image forming apparatus such as a color electrophotographic apparatus and a color image forming method using this apparatus.

Digital full-color electrophotography uses the following method. First, R (red), G (green), and B (blue) image signals of an original read from a scanner or R, G, and B image signals obtained through an external interface are color-converted into Y (yellow), M (magenta), and C (cyan). Black generation and color correction are performed to produce signals of four colors Y, M, C, and K (black).

After that, magnification change such as enlargement or reduction is performed, and image area separation is performed to separate a character-line region and a halftone region from each other. Furthermore, spatial filter processing for performing edge emphasis-MTF correction, smoothing-moiré removal, and the like is performed, and γ conversion is performed to obtain a linear relationship between the recording signal intensity and the reproduced image density. Finally, to output the data to a laser or a liquid crystal filter, halftoning is performed by assembling a dot pattern or a line pattern by dithering or error diffusion.

Depending on the type of output device, this method expresses not only binary signals but also multilevel signals by varying the intensity of a laser or varying the pulse width, and can thereby more smoothly express halftone with high resolution. Hence, this method is essential for clear image expression.

A photoreceptor having a charged surface is irradiated with the Y, M, C, and K optical signals generated by a laser or a liquid crystal filter through the image processing as described above. This produces a potential drop and forms an electrostatic latent image. The latent image is visualized by bringing charged toner into contact with the image. Other image visualizing schemes are a method (tandem scheme) which uses separate photoreceptors for four colors Y, M, C, and K and separately develops images of these four colors, and a scheme by which latent images of Y, M, C, and K are sequentially formed and developed by a single photoreceptor and transferred onto an intermediate transfer medium or a paper sheet. After being transferred onto a paper sheet, toner components of the four colors are melted to mix these colors by a fixing device such as a heat roller. A final image is obtained through a series of electrophotographic processes as described above.

Both the digital image processing and analog electrophotographic process described above are factors that determine the final image. In particular, the stability of the electrophotographic process is important for the stability of an image. Throughout life, during continuous copying, and against environmental changes, the same image must be output for the same input optical image for each of the four colors. For this purpose, the apparatus includes, as an image quality maintaining mechanism, a mechanism which varies the surface potential or development bias of a photoreceptor or varies the toner specific density, in accordance with the life counter or with temperature and humidity fluctuations. It is also possible to use a mechanism which actually develops a test pattern on a transfer belt or the like and feeds the result back to the process conditions so that the same image density is maintained.

In this manner, the γ values of the four colors must be adjusted to be constant at any time. Otherwise, the image density changes, or a color shift occurs if the four colors change separately. For example, a bluish image or a yellowish image forms. However, the process conditions such as the surface potential and bias of a photoreceptor and the toner specific density cannot be unlimitedly changed from a physical or image-quality viewpoint. Finally, the physical properties of a developing agent, particularly the stability of the charging characteristics is important. For example, if the charge amount becomes too large, the adhesive force to a carrier abruptly increases, so no sufficient ID can be obtained even when the development contrast potential is raised. On the other hand, if the charge amount becomes too small or if 0 charge or reverse charge increases in a charge amount distribution, fog or toner scattering increases even when the white contrast potential is raised.

Also, when multilevel exposure is performed to improve tone reproduction, the potential on the photoreceptor eventually becomes multilevel and is readily influenced by the γ characteristic of development. Hence, the stability of the characteristics of a developing agent is more and more required.

Color toner generally contains a binder, wax, colorant, charge control agent, and additive. It is basically necessary to use colorless materials except for pigments. As a charge control agent (CCA), not colored azo-based CCAs used in monochromatic toner but colorless CCAs such as a complex of salicylic acid-based zinc, boron complex, quaternary ammonium salt, and resin are extensively used. However, no CCA stable throughout its life and against environmental changes is obtained.

As a colorant, an organic pigment is generally used except for carbon black used as black. Examples of magenta pigments are an azolake pigment, β naphthol insoluble azo pigment, naphthol AS insoluble azo pigment, pyrazolone pigment, quinacridone pigment, carbazole violet pigment, perillene pigment, and thioindigo pigment. Examples of yellow pigments are a monoazo yellow pigment, benzidine yellow pigment, monoazo yellow lake pigment, benzimidazolone pigment, and condensed azo pigment. Examples of cyan pigments are a phthalocyanine pigment and indanthrene blue pigment.

To improve the color generation and transparency, these pigments and a binder resin are generally subjected to preliminary dispersion called masterbatch. Dispersibility is improved by enhancing dispersion by a kneader such as a three-roll mill which applies a shearing force, by dispersing crude pigments before drying, or by adding a dispersing agent. Dispersion is basically dominated by the chemical affinity between pigments and a binder resin.

The dispersibility of a pigment has influence not only on the transparency but also on the chargeability of toner, since the pigment itself has high chargeability. Generally, if the dispersibility is low, the charge amount distribution widens, and this increases fog and toner scattering. Also, the structure of a pigment has influence on the chargeability and the environmental resistance. To improve the dispersibility of a pigment, a large amount of a polar group such as a carboxyl group can be added to the binder resin. This method is readily achievable when a polyester resin commonly used in color toner is used. However, the charge amount easily decreases in a high-humidity environment or by developing agent stirring throughout life.

As described above, pigments are selected in accordance with the dispersibility to resin, the chargeability, and the tone of color transparency. In particular, the color tone is preferably so selected as to be close to Japan colors as standard colors of three primary colors Y, M, and C. In addition, in accordance with recent regulations for the sake of safety, the use of, e.g., a benzidine yellow pigment is often avoided.

Also, to obtain a color tone having high saturation, the transparency of each toner must be high, and it is necessary to obtain a uniform fixing surface with little graininess in order to suppress diffused reflection on the surface or in the grain boundary. To this end, a low-molecular-weight polyester resin which-readily sharply melts is generally used as a binder. However, the mechanical strength of this low-molecular-weight polyester resin is low, so sufficient life is difficult to ensure.

Toner which easily sharply melts often produces offset because the elasticity during melting lowers. Therefore, the general conventional approach is to use a mechanism which prevents offset by steadily coating a fixing roller with silicone oil. In this method, however, the oil adheres to a fixed printed product. Especially when an image is fixed on an OHP sheet, the oil forms fringe patterns on the image or makes the image sticky during storage. Additionally, an oil supplementing mechanism increases the size of the machine, and periodically supplementing the oil to a tank is cumbersome.

To prevent offset, it was attempted to suppress a lowering of the viscoelasticity at high temperatures by changing the molecular weight distribution of a resin. However, achieving this effect and the transparency or color generation of OHP at the same time was difficult. Therefore, in recent years it is being attempted to improve the offset characteristic such that a device for supplementing oil to a heat roller is unnecessary, while maintaining sharp melting by adding low-melting-point wax to toner.

Even when a soft resin or wax is used as a binder, additives such as silica, titanium oxide, and alumina are generally added in amounts larger than in monochromatic toner, for the purposes of holding an appropriate toner flowability and preventing spent toner or filming. This, however, allows easy chargeability change due to environmental changes and makes it difficult to maintain stable chargeability throughout life.

As described above, stable charging characteristics of full-color toner are difficult to maintain against environment changes or throughout life. Also, since the chargeability changes differently by Y, M, C, and K, changes in the chargeability appear as a change in the color tone of a copied image, a change in the image density, fog, toner scattering, and the like. Although it is being attempted to correct such nonuniform charging characteristics by the process conditions or by the mechanism, the correction has its limits. Additionally, frequent correction and adjustment worsen the response and ease of use of the machine.

BRIEF SUMMARY OF THE INVENTION

It is an object of the present invention to provide an image forming apparatus which maintains stable charging characteristics against environmental changes and throughout life, and can form high-quality images having a good color tone and sufficient image density and having no problems in fog and toner scattering.

It is another object of the present invention to provide a method which maintains stable charging characteristics against environmental changes and throughout life, and forms high-quality images having a good color tone and sufficient image density and having no problems in fog and toner scattering.

According to the first aspect of the present invention, there is provided an image forming apparatus comprising first to fourth image carriers, first to fourth developing devices opposing the first to fourth image carriers in one-to-one correspondence with each other to develop first to fourth electrostatic latent images, formed on the first to fourth image carriers, by using first to fourth developing agents, thereby forming first to fourth developing agent images, first to fourth transfer means, arranged after the first to fourth developing devices in one-to-one correspondence with each other, for transferring the first to fourth developing agent images onto a transfer medium, and a fixing device for fixing the transferred first to fourth developing agent images on the transfer medium, wherein as each of the first to fourth developing agents, one of a yellow developing agent containing a polyester resin having a pre-determined acid value, a zirconium complex of a salicylic acid derivative, and a benzimidazolone pigment as a yellow pigment, a magenta developing agent containing a polyester resin having a pre-determined acid value, a zirconium complex of a salicylic acid derivative, and a naphthol AS insoluble azo pigment as a magenta pigment, a cyan developing agent containing a polyester resin having a pre-determined acid value, a zirconium complex of a salicylic acid derivative, and a phthalocyanine pigment as a cyan pigment, and a black developing agent containing a polyester resin having a pre-determined acid value, a zirconium complex of a salicylic acid derivative, and carbon black as a black pigment is applied.

According to the second aspect of the present invention, there is provided an image forming apparatus comprising an image carrier, first to fourth developing devices opposing the image carrier to develop first to fourth electrostatic latent images, sequentially formed on the image carrier, by using first to fourth developing agents, thereby forming first to fourth developing agent images, transfer means, arranged after the first to fourth developing devices, for transferring the first to fourth developing agent images, and a fixing device for fixing the transferred first to fourth developing agent images on a transfer medium, wherein as each of the first to fourth developing agents, one of a yellow developing agent containing a polyester resin having a pre-determined acid value, a zirconium complex of a salicylic acid derivative, and a benzimidazolone pigment as a yellow pigment, a magenta developing agent containing a polyester resin having a pre-determined acid value, a zirconium complex of a salicylic acid derivative, and a naphthol AS insoluble azo pigment as a magenta pigment, a cyan developing agent containing a polyester resin having a pre-determined acid value, a zirconium complex of a salicylic acid derivative, and a phthalocyanine pigment as a cyan pigment, and a black developing agent containing a polyester resin having a pre-determined acid value, a zirconium complex of a salicylic acid derivative, and carbon black as a black pigment is applied.

According to the third aspect of the present invention, there is provided an image forming method comprising the development/transfer step of developing first to fourth electrostatic latent images, formed on first to fourth image carriers, by using first to fourth developing agents having different colors, thereby forming first to fourth developing agent images, and sequentially transferring the first to fourth developing agent images onto a transfer medium, and the fixing step of fixing the transferred first to fourth developing agent images on the transfer medium, wherein as each of the first to fourth developing agents, one of a yellow developing agent containing a polyester resin having a pre-determined acid value, a zirconium complex of a salicylic acid derivative, and a benzimidazolone pigment as a yellow pigment, a magenta developing agent containing a polyester resin having a pre-determined acid value, a zirconium complex of a salicylic acid derivative, and a naphthol AS insoluble azo pigment as a magenta pigment, a cyan developing agent containing a polyester resin having a pre-determined acid value, a zirconium complex of a salicylic acid derivative, and a phthalocyanine pigment as a cyan pigment, and a black developing agent containing a polyester resin having a pre-determined acid value, a zirconium complex of a salicylic acid derivative, and carbon black as a black pigment is applied.

According to the fourth aspect of the present invention, there is provided an image forming method comprising the development/transfer step of developing and transferring first to fourth electrostatic latent images, sequentially formed on an image carrier, by using first to fourth developing agents having different colors, thereby forming first to fourth developing agent images sequentially on a transfer medium, and the fixing step of fixing the transferred first to fourth developing agent images on the transfer medium, wherein as each of the first to fourth developing agents, one of a yellow developing agent containing a polyester resin having a pre-determined acid value, a zirconium complex of a salicylic acid derivative, and a benzimidazolone pigment as a yellow pigment, a magenta developing agent containing a polyester resin having a pre-determined acid value, a zirconium complex of a salicylic acid derivative, and a naphthol AS insoluble azo pigment as a magenta pigment, a cyan developing agent containing a polyester resin having a pre-determined acid value, a zirconium complex of a salicylic acid derivative, and a phthalocyanine pigment as a cyan pigment, and a black developing agent containing a polyester resin having a pre-determined acid value, a zirconium complex of a salicylic acid derivative, and carbon black as a black pigment is applied.

In the present invention, it is possible to maintain stable charging characteristics against environmental changes and throughout life, and form high-quality images having a good color tone and sufficient image density and having no problems in fog and toner scattering.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
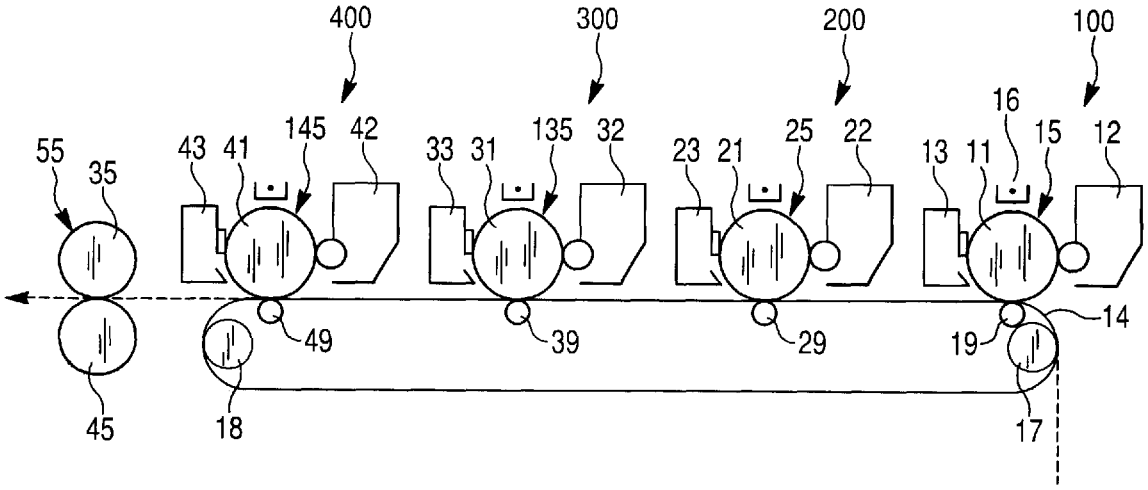
FIG. 1 is a schematic view showing an example of an image forming apparatus of the present invention.

An image forming apparatus of the present invention uses the aforementioned four types of developing agents as first to fourth developing agents. This image forming apparatus comprises first to fourth image carriers, first to fourth developing devices opposing the first to fourth image carriers in one-to-one correspondence with each other to develop first to fourth electrostatic latent images, formed on the first to fourth image carriers, by using first to fourth developing agents, thereby forming first to fourth developing agent images, first to fourth transfer means, arranged after the first to fourth developing devices in one-to-one correspondence with each other, for transferring the first to fourth developing agent images onto a transfer medium, and a fixing device for fixing the transferred first to fourth developing agent images on the transfer medium, wherein as the first to fourth developing agents, a yellow developing agent containing a polyester resin having a pre-determined acid value, a zirconium complex of a salicylic acid derivative, and a benzimidazolone pigment as a yellow pigment, a magenta developing agent containing a polyester resin having a pre-determined acid value, a zirconium complex of a salicylic acid derivative, and a naphthol AS insoluble azo pigment as a magenta pigment, a cyan developing agent containing a polyester resin having a pre-determined acid value, a zirconium complex of a salicylic acid derivative, and a phthalocyanine pigment as a cyan pigment, and a black developing agent containing a polyester resin having a pre-determined acid value, a zirconium complex of a salicylic acid derivative, and carbon black as a black pigment are applied.

Another image forming apparatus of the present invention comprises an image carrier, first to fourth developing devices opposing the image carrier to develop first to fourth electrostatic latent images, sequentially formed on the image carrier, by using first to fourth developing agents, thereby forming first to fourth developing agent images, transfer means, arranged after the first to fourth developing devices, for transferring the first to fourth developing agent images, and a fixing device for fixing the transferred first to fourth developing agent images on a transfer medium.

An image forming method of the present invention uses the abovementioned first to fourth developing agents and comprises the development/transfer step of developing first to fourth electrostatic latent images, formed on first to fourth image carriers, by using the first to fourth developing agents, thereby forming first to fourth developing agent images, and sequentially transferring the first to fourth developing agent images onto a transfer medium, and the fixing step of fixing the transferred first to fourth developing agent images on the transfer medium.

Another image forming method of the present invention uses the abovementioned first to fourth developing agents and comprises the development/transfer step of developing and transferring first to fourth electrostatic latent images, sequentially formed on an image carrier, by using the first to fourth developing agents, thereby forming first to fourth developing agent images sequentially on a transfer medium, and the fixing step of fixing the transferred first to fourth developing agent images on the transfer medium.

In the present invention, the aforementioned predetermined pigments, a polyester resin having a pre-determined acid value, and a zirconium complex of a colorless salicylic acid derivative as a charge control agent (CCA) are used. Therefore, the charging characteristics of developing agents of three colors yellow, magenta, and cyan are stable throughout life and against environmental changes, so stable images are provided.

In particular, the effect of the present invention significantly appears when a polyester resin having an acid value of 6 or less is used.

To faithfully reproduce full-color images, suitable control of the color tones of developing agents used and developing agent amounts (ID) to be adhered is required. As the color tones, it is necessary to reproduce colors based on process inks of yellow, magenta, and cyan. In Japan, the color tones called Japan colors are standard color tones. To reproduce colors close to the standard color tones, it is required that not only the color tones of pigments be close to the standard color tones but also the dispersibility to resin and the transparency be high, and that no unclear colors be generated by colored additives.

Also, the development γ characteristics of developing agents of four colors, i.e., the three colors described above plus black must be substantially equal throughout life and against environmental changes. To output full-color images, Y, M, C, and K signals are formed in accordance with input R, G, and B image signals. In an image formation process, toner is developed to visualize an image. The intensity of an output signal is expressed by, e.g., the output intensity of a laser, a pulse width, or a dot pattern, and is converted into a potential signal on a photoreceptor drum. When this potential latent image is to be developed, the development γ characteristics of the four colors may be basically the same. If the characteristics are different, an image tends to become, e.g., bluish or yellowish. For this fine color adjustment, it is preferably to automatically or manually adjust the development bias for each color to equalize the development γ characteristics of the four colors. If the γ characteristics of developing agents of the four colors are basically not substantially close, they cannot be adjusted on the M/C side. To equalize the γ characteristics, the charging characteristics of developing agents of the four colors may be stable in the initial stages, throughout life, and against environmental changes.

By contrast, a benzimidazolone pigment, naphthol AS insoluble azo pigment, and phthalocyanine pigment used in the present invention can well satisfy these requirements.

Pigment Yellow 180, Pigment Red 184, and Pigment Blue 15:3 are preferably used as yellow, magenta, and cyan pigments, respectively, of developing agents used in the present invention.

By the use of these pigments, the charging characteristics of the three colors are substantially equal against environmental changes and stable throughout life. Also, the dispersibility of each material and the transparency improve, and the reproducibility of full-color images is very high.

A naphthol AS insoluble azo pigment uses as a magenta pigment in the present invention is formed by polymerizing a β naphthol azo pigment in which anilide is introduced. Known examples are Pigment Reds 5, 1 7, 95, 11 2, 114, 146, 147, 150, 170, 184, 210, and 253. A polar group and crystal water appear little to the outside unlike in an azolake pigment. Generally, the negative chargeability is low, and changes with environmental changes are small.

In contrast, an azolake pigment such as Carmine 6B (Pigment Red 57:1) used most popularly in printing ink and the like is a pigment in the form of metal salt. So, the negative chargeability is generally high. Therefore, the charge amount readily increases throughout life and is difficult to control. Also, the presence of a polar group and crystal water often largely changes the charge amount against environmental changes. These drawbacks make this azolake pigment impractical.

As other magenta pigments, quinacridone-based polycyclic pigments such as quinacridone of Pigment Violet 19 and dimethylquinocridone of Pigment Red 122 are generally used. However, these pigments are difficult to disperse, have weak coloring power, and shift to pinkish colors, i.e., deviate from Japan colors. Additionally, the negative chargeability is slightly high, so it is difficult to obtain balance with black or cyan having pre-determined chargeability.

The present inventors examined pigments by combining them with a polyester resin as described above. Consequently, naphthol AS insoluble azo pigments were most balanced in characteristics such as dispersibility and chargeability as magenta pigments. In particular, Pigment Red 184 was most superior in color balance. The structural formula of Pigment Red 184 is represented by:

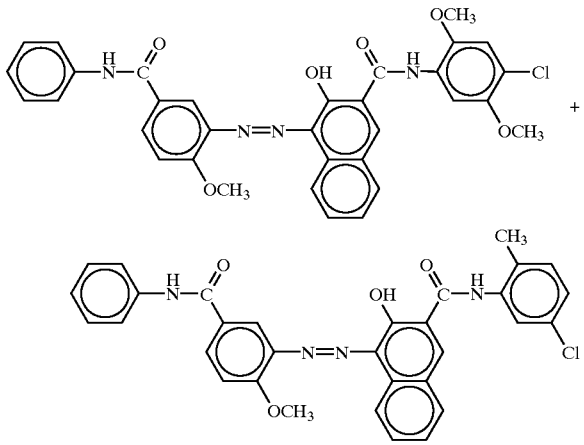

A benzimidazolone pigment used as a yellow pigment is formed by introducing a heterocyclic ring to an insoluble azo pigment. Examples are Pigment Yellows 120, 151, 154, 175, 180, and 181. Of these pigments, Pigment Yellow 180 represented by formula (2) below takes the form of a bond of two benzimidazolone molecules and is superior in coloring power, resistance to weather, and dispersibility. Also, the chargeability is not so high, and fluctuations with environmental changes are small.

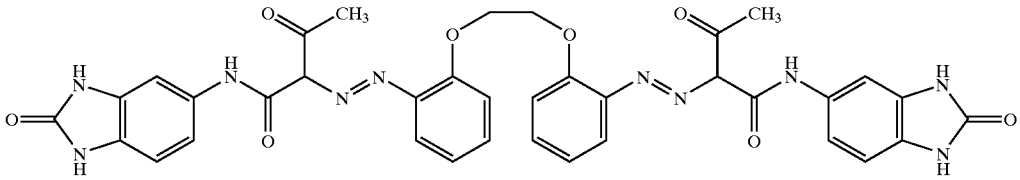

Conventionally, benzidine yellow such as Pigment Yellow 17 has been widely used because the pigment has high coloring power and various stable characteristics. However, this pigment is currently not used so often as before because of the safety issue of a decomposition product. A monoazo yellow pigment is low-molecular and hence has problems in heat resistance and transfer. Also, a condensed azo pigment could not provide satisfactory results in coloring power, transparency, and dispersibility. The performances in a dispersed state, the stabilities of charging, and the like of low-acid-value polyesters were compared. Consequently, the results of a benzimidazolone pigment were the best.

A phthalocyanine pigment used as a cyan pigment is a polycyclic pigment having a metal in the center and is one of the most popular pigments since it has high coloring power and high stability. Examples of the central metal are copper, hydrogen, aluminum, and cobalt, and copper is mainly used. Examples of the crystal system are α, β, and γ, and an α or β system is finely pulverized and used as a pigment. Outside hydrogen is replaced with halogen to shift the hue to the edge. Generally, Pigment Blue 15:3 represented by formula (3) below is used. A phthalocyanine pigment has almost no chargeability and has low dependence on environment. However, this pigment is hard and difficult to disperse, so caution should be exercised on dispersibility in the formation of a masterbatch.

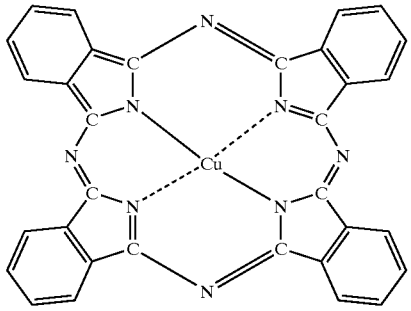

By using the Y, M, and C pigments described above, carbon black as a pigment in black toner, a polyester resin having a pre-determined acid value as a binder resin, and a zirconium complex of a salicylic acid derivative as a CCA, it is possible to obtain toner in which the dispersibility to a binder is high and the chargeabilities of the four colors are stable against environmental changes and throughout life.

In the present invention, by selecting polyester having a pre-determined acid value as a binder resin, it is possible to obtain a full-color developing agent in which the charge amount has small dependence on environment and changes little throughout life. Also, the Y, M, and C pigments and carbon black pigment used in the present invention are well dispersed in a polyester resin having a pre-determined acid value and have low chargeabilities close to each other. Therefore, toner components of the four colors can have uniform chargeability. The charge amount varies little throughout life and with environmental changes. In addition, the present invention can further stabilize the chargeability by the use of a zirconium complex of a salicylic acid derivative as a CCA.

A CCA is used to charge toner. This CCA is functionally required to decrease the charge amount little at high humidity, increase the rise speed of charging, and change little upon repetitive friction. These characteristics of a CCA are presumably influenced by the dispersibility of a CCA to a binder and the difference in chargeability from a carrier, as well as its chemical structure. Table 1 shows the types of colorless CCAs used in the examination and toner charging characteristics. According to Table 1, a zirconium complex of a salicylic acid derivative has the most stable chargeability. A chromium complex which is also based on salicylic acid and superior in characteristics to a zinc complex is not used in the present invention, since it slightly generates color and is inferior in respect of environmental pollution.

To obtain the comparison shown in Table 1, each toner was formed by mixing and kneading a polyester resin having an acid value of 3, 6% of Pigment Red 184 as a pigment, and 1% of a CCA, and pulverizing and classifying the resultant material to obtain a diameter of 8 μm.

The dependences on environment were compared using raw toner components. The charge amount changes throughout life were compared by adding 1% of hydrophobic silica and 1% of titanium oxide as additives.

Each developing agent was formed at a toner specific density of 5.5% by using a silicone-coated ferrite carrier.

The charge amounts were compared by q/d by using an E-Spart analyzer manufactured by HOSOKAWA MICRON CORP.

The content of a zirconium complex of a salicylic acid derivative in toner particles is preferably 0.1 to 3 wt %, and more preferably, 0.2 to 2 wt %. If the content is less than 0.1 wt %, the chargeability becomes unsatisfactory to cause a reduction in the charge amount at high humidity or cause changes in the charge amount throughout life. If the content is larger than 3 wt %, the charge amount becomes too large, and this decreases the image density. Also, low dispersibility causes filming to a photoreceptor, spent toner to a carrier, or the like.

TABLE 1

| Types of CCA and Charge Stability | | | | | | |
|---|---|---|---|---|---|---|
| | Raw toner charge amount | | | Toner charge amount | | |
| CCA type | N/N charge amount | H/H charge amount | Environment change rate | N/N charge amount | Life charge amount | Life change rate |
| Salicylic acid derivative zirconium complex | 2.2 | 1.8 | 82% ○ | 4.3 | 3.6 | 84% ○ |
| Salicylic acid derivative zinc complex | 0.9 | 0.2 | 22% X | 4.0 | 2.2 | 55% X |
| Boron complex | 2.3 | 1.9 | 83% ○ | 4.5 | 2.8 | 62% X |
| Calics allene | 1.7 | 0.7 | 41% X | 3.4 | 2.1 | 62% X |
| Quaternary ammonium salt | 2.1 | 1.2 | 57% Δ | 3.6 | 1.8 | 50% X |
| No CCA | 0.6 | 0.1 | 17% X | 2.8 | 1.2 | 43% X |

The structure of a binder resin is not particularly restricted as long as the resin is a polyester resin having a predetermined acid value. So, commonly used thermoplastic polyester can be used. The acid value is preferably 6 or less, and more preferably, 5 or less.

The polyester resin herein mentioned is a resin having as its main chain a polymer formed by ester condensation of polyvalent acid and polyvalent alcohol. A saturated or unsaturated monomer can be used. If a monomer has an unsaturated double bond, a vinyl monomer such as styrene can be further copolymerized. However, it is unpreferable that crosslinking progress too much, which results in a hard material. Although trivalent acid such as trimellitic acid is also usable, the acid value becomes too high, and the crosslinking structure makes the resin difficult to melt. In full-color toner, a low-molecular-weight linear polyester resin containing divalent acid and divalent alcohol and having sharp melting characteristics is preferably used.

Examples of the divalent acid as monomers are phthalic acid, terephthalic acid, fumaric acid, maleic acid, sebacic acid, succinic acid, and adipic acid. Examples of the divalent alcohol as monomers are aliphatic glycol such as ethylene glycol, propylene glycol, butylene glycol, and butenediol. More general examples are an ethylene oxide adduct and propylene oxide adduct of bisphenol A of an aromatic group.

A developing agent used in the present invention can contain wax in addition to a binder resin. Examples of the wax are natural wax such as rice wax and carnauba wax, petroleum wax such as paraffin wax, and synthetic wax such as aliphatic acid ester, aliphatic acid amide, low-molecular-weight polyethylene, and low-molecular-weight polypropylene.

In addition, internal/external lubricating agents, cleaning assistants, fluidizing agents, and the like can be added as needed.

A metal oxide such as silica, titanium oxide, or alumina can be used as additives for mix, and the surfaces of additives used can be treated by or by an organic substance such as silane coupling or silicone oil. It is also possible to use metal soap such as zinc stearate, an inorganic powder such as barium titanate or strontium titanate, or an organic powder such as PMMA, silicone resin, PTFE, or polyvinylidene fluoride.

A developing agent manufacturing method and manufacturing apparatus are also not particularly limited. As a common color developing agent manufacturing method, a developing agent can be obtained by forming a masterbatch by using resins and pigments, uniformly mixing, kneading, and cooling the masterbatch, resins, wax, a charge control agent, and the like, pulverizing and classifying the resultant material to a predetermined size, and adding to mix additives with the resultant material such as silica and titanium oxide.

The present invention will be described in further detail below with reference to the drawings.

One example of an image forming apparatus of the present invention will be described below with reference to FIG. 1.

Referring to FIG. 1, a photoreceptor drum 11 as an image carrier is a cylindrical stacked organic photoreceptor 40 mm in diameter and 266 mm in length and is rotatable in the direction of an arrow.

Around this photoreceptor drum 11, the following devices are arranged along the rotating direction. That is, an exposure unit 15 forms an electrostatic latent image by exposing the surface of the photoreceptor 11 charged by a charging roller (not shown). A developing device 12 is placed downstream of this exposure unit 15. This developing device 12 contains a developing agent and with this developing agent develops the electrostatic latent image formed by the exposure unit 15. A conveyor means 14 is placed downstream of the developing device 12 and conveys a paper sheet as a transfer medium to the photoreceptor drum 11.

Furthermore, a blade cleaning device 13 and a charge removal lamp (not shown) are placed downstream of a position where the photoreceptor drum 11 comes in contact with a paper sheet.

The conveyor means 14 has a width substantially equal to the drum width of the photoreceptor drum 11. This conveyor means 14 takes the form of an annular belt. A tension roller 17 and a driving roller 18 are placed in the upstream and downstream annular portions, respectively, of the conveyor means 14. In these annular portions, the conveyor means 14 is in contact with the tension roller 17 and the driving roller 18 along the outer circumferential surfaces of these rollers. The distance from the tension roller 17 to the driving roller 18 is approximately 300 mm.

The tension roller 17 and the driving roller 18 can rotate in the directions of arrows shown in FIG. 1. When the driving roller 18 rotates, the conveyor means 14 is annularly fed. The conveyance rate is so controlled as to synchronize with the rotating speed of the photoreceptor drum 11.

The photoreceptor drum 11, the exposure unit 15, the developing device 12, the blade cleaning device 13, and the charge removal lamp 16 constitute a process unit 100.

On the conveyor means 14, this process unit 100 and process units 200, 300, and 400 are arranged in the conveyance direction between the tension roller 17 and the driving roller 18. The process units 200, 300, and 400 have the same arrangement as the process unit 100.

That is, the photoreceptor drum 11 and photoreceptor drums 21, 31, and 41 are placed in substantially the centers of the corresponding process units. Around these photoreceptor drums, exposure units 25, 135 and 145 and, downstream of these exposure units 25, 135, and 45, developing devices 22, 32, and 42 and blade cleaning devices 23, 33, and 43 are arranged. This arrangement is also the same as the process unit 100.

The difference between these process units is a developing agent contained in the developing device. For example, the developing device 12 contains a yellow developing agent which contains a polyester resin having an acid value of 6 or less, a zirconium complex of a salicylic acid derivative, and a benzimidazolone pigment as a yellow pigment. The developing device 22 contains a magenta developing agent which contains a polyester resin having an acid value of 6 or less, a zirconium complex of a salicylic acid derivative, and a naphthol AS insoluble azo pigment as a magenta pigment, the developing device 32 contains a cyan developing agent which contains a polyester resin having an acid value of 6 or less, a zirconium complex of a salicylic acid derivative, and a phthalocyanine pigment as a cyan pigment, and the developing device 42 contains a black developing agent which contains a polyester resin having an acid value of 6 or less, a zirconium complex of a salicylic acid derivative, and carbon black as a black pigment.

To output a color image, a paper sheet conveyed by the conveyor means 14 is brought into contact with the photoreceptor drums 11, 21, 31, and 41 in turn. In the contact positions between this paper sheet and the photoreceptor drums 11, 21, 31, and 41, power supply rollers 19, 29, 39, and 49 are placed in one-to-one correspondence with the photoreceptor drums 11, 21, 31, and 41.

That is, in the positions of contact with the corresponding photoreceptor drums 11, 21, 31, and 41, the power supply rollers 19, 29, 39, and 49 contact the back surface of the conveyor means 14 and oppose the photoreceptor drums 11, 21, 31, and 41, respectively, via the conveyor means 14. These power supply rollers 19, 29, 39, and 49 are connected to bias power supplies (not shown) and rotate following the movement of the conveyor means 14.

An image formation process of the image forming apparatus constructed as above will be described below. The rotating photoreceptor drums 11, 21, 31, and 41 of the four process units described above are uniformly charged to 50 V by charging means (not shown) applied with AC-superposed DC bias.

The photoreceptor drums 11, 21, 31, and 41 thus uniformly charged are irradiated with light by the exposure units 15, 25, 135, and 145 which perform exposure by using a phosphor, thereby forming electrostatic latent images. These electrostatic latent images are developed by the developing agents of different colors previously well charged by the developing devices 12, 22, 32, and 42.

Meanwhile, a paper sheet is supplied from a paper feed cassette (not shown) to the transfer position of the photoreceptor drum 11.

When the paper sheet is conveyed to the transfer position, the power supply rollers 19, 29, 39, and 49 apply a voltage of about 1,400 V as a bias voltage to the conveyor means 14. This bias voltage applied forms transfer electric fields between the photoreceptor drums 11, 21, 31, and 41 and the conveyor means 14. Accordingly, the developing agent image on the photoreceptor drum 11 is first transferred onto the paper sheet. The paper sheet carrying this developing agent image is conveyed to the photoreceptor drum 21. The developing agent image formed on this photoreceptor drum 21 is transferred onto the previously transferred developing agent image. The paper sheet is further conveyed, and the developing agent images of the other colors are transferred onto the paper sheet by the photoreceptor drums 31 and 41.

The paper sheet carrying the image formed by the multiple transfer as described above is supplied to a fixing device 55 from the conveyor means 14. This fixing device 55 has a heat roller 35 and a press roller 45. The paper sheet is passed between the heat roller and the pressure roller such that the image is in contact with the heat roller. In this way, the image is fixed on the paper sheet.

Figure 2:
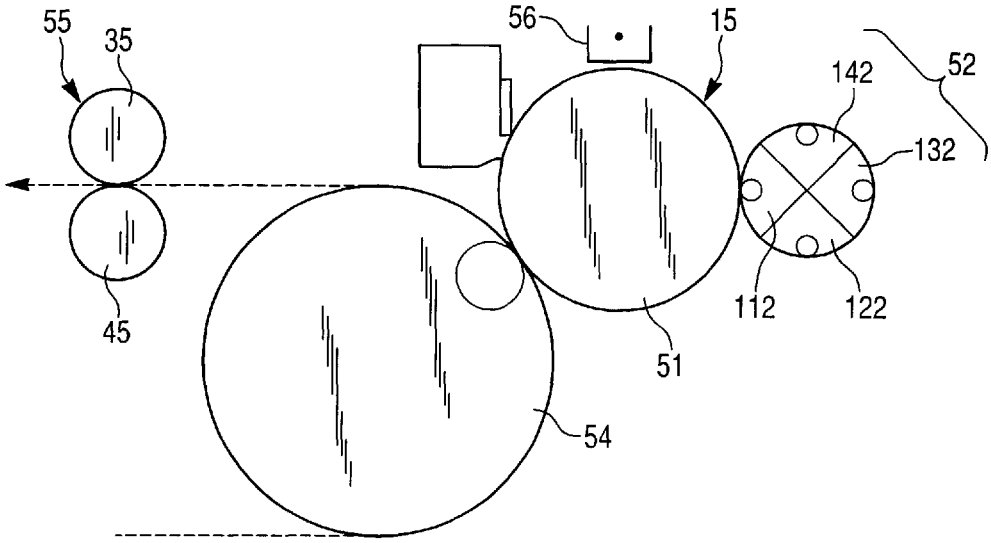
FIG. 2 is a schematic view showing another example of the image forming apparatus of the present invention.

FIG. 2 shows another example of the image forming apparatus of the present invention.

In the image forming apparatus shown in FIG. 2, a developing unit 52 is placed on a common photoreceptor drum 51. In this developing unit 52, four developing devices 112, 122, 132, and 142 containing developing agents of four colors similar to the developing agents used in the apparatus shown in FIG. 1 are integrally formed to be rotatable. Downstream of the developing unit 52, a transfer roller 54, a cleaning device 53, and a chare removal device 56 are arranged. Furthermore, a fixing device 55 including a heat roller 35 and a press roller 45 is laced downstream of the photoreceptor drum 51. In this apparatus, the developing device 112 develops an electrostatic latent image on the common photoreceptor drum 51. The obtained developing agent image is transferred into a paper sheet conveyed to a transfer position between the transfer roller 54 and the photoreceptor drum 51. After that, the cleaning device 53 cleans the photoreceptor drum 51, and the charge removal device 56 removes charge from the photoreceptor drum 51, thereby completing one transfer cycle. Subsequently, the developing device 122 develops an image, and a similar transfer operation is performed. Analogous development and transfer are also performed for the developing devices 132 and 142. The developing agent images thus formed on the paper sheet by the multiple transfer are fixed in the same manner as in the apparatus shown in FIG. 1.

EXAMPLE S

The present invention will be described in more detail below by way of its examples.

Example 1

Magenta, yellow, cyan, and black developing agents were formed as follows.

(1) Formation of Magenta Developing Agent

Propylene oxide and ethylene oxide adducts of bisphenol A as alcohol components and terephthalic acid as an acid component were polymerized to synthesize a polyester resin having an Mw of 13,000, an Mn of 3,000, an acid value of 3, a Tg of 63° C., and a softening point of 106° C.

70 parts by weight of the obtained polyester resin and 30 parts by weight of a naphthol AS insoluble azo-based magenta pigment (Pigment Red 184) were kneaded by a press kneader and passed through two rolls to form a masterbatch of the magenta pigment.

20 parts by weight of the obtained masterbatch, 73 parts by weight of the polyester resin, 6 parts by weight of LAX-N-100A rice wax (available from NS Chemical Limited Responsibility Company: melting point=79° C., kinematic viscosity at 100° C.=18 cSt), and 1 part by weight of TN-105 (a salicylic acid derivative zirconium complex manufactured by Hodogaya Chemical Co., Ltd.) as a CCA were uniformly mixed by a Henschel mixer, kneaded by a PCM45 biaxial extruder, cooled, and pulverized. The resultant material was further finely pulverized by a jet pulverizer. The fine powder was cut by an air classification machine to obtain magenta toner particles having a 50%-volume particle size of 8.0 μmg. 2 parts by weight of a fine silica powder (NAX50 hydrophobic silica available from Nippon Aerozyl: BET specific surface area=40 $m^2/g$), 1 part by weight of a fine titanium oxide powder (STT-30A manufactured by Titan Kogyo K.K.), and 0.5 parts by weight of zinc stearate (grain size=4 μm) were mixed as additives in 100 parts by weight of the magenta toner particles by a Henschel mixer for 3 min. The mixture was screened through a 200-mesh screen to obtain negatively chargeable magenta toner.

The obtained magenta toner was mixed in a Powder Tech EFCS1-60 carrier (average particle size=60 μm, maximum magnetization=64 emu/g) at a toner specific density of 5.5%, thereby forming a magenta developing agent.

The obtained magenta developing agent was placed in a Toshiba Tech FC-22 digital full-color copying machine, and images were evaluated. Consequently, clear magenta images were obtained.

The initial ID was 1.80 (at a development contrast potential of 250 V), and the charge amount was 4.3 (measured by a femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.6.

Also, no filming to the photoreceptor was found, and high-quality halftone images having no blotches were obtained.

Furthermore, images were transferred onto OHP sheets, and the transmittance was measured and found to be as high as 74%.

When evaluation was performed in a 30° C.-85%RH environment, the ID was 1.85 (development contrast potential=180 V), and the charge amount was 3.5 by Q/d. In a 10° C.-20%RH environment, the ID was 1.78 (development contrast potential=300 V), and the charge amount was 4.6 by Q/d. In either environment, fog was of no problem at a white potential of 150 V.

Additionally, the obtained developing agent was placed in a polyethylene vessel and dipped into a constant temperature bath at 55° C. for 8 hr. When the developing agent was observed after that, almost no flocculation was found, and the heat storage characteristic was also good.

(2) Formation of Yellow Developing Agent

A yellow developing agent was formed following the same procedures as for the magenta developing agent except that a Pigment Yellow 180 benzimidazolone pigment was used as a pigment.

When the obtained yellow developing agent was evaluated in the same manner as for the magenta developing agent, clear yellow images were obtained.

The initial ID was 1.81 (at a development contrast potential of 250 V), and the charge amount was 4.4 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.8.

Also, no filming to the photoreceptor was found, and high-quality halftone images having no blotches were obtained.

Images were transferred onto OHP sheets, and the transmittance was measured and found to be as high as 73%.

When evaluation was performed in a 30° C.-85%RH environment, the ID was 1.83 (development contrast potential=190 V), and the charge amount was 3.6 by Q/d. In a 10° C.-20%RH environment, the ID was 1.79 (development contrast potential=300 V), and the charge amount was 4.6 by Qid. In either environment, fog was of no problem at a white potential of 150 V.

After this yellow developing agent was placed in a polyethylene vessel and dipped into a constant temperature bath at 55° C. for 8 hr, almost no flocculation of toner was found, and the heat storage characteristic was also good.

(3) Formation of Cyan Developing Agent

A cyan developing agent was formed following the same procedures as for the magenta developing agent except that a Pigment Blue 15:3 phthalocyanine pigment was used as a pigment and diluted by using 15 parts by weight of a masterbatch and 78 parts by weight of a polyester resin.

When the obtained cyan developing agent was evaluated in the same manner as for the magenta developing agent, clear cyan images were obtained.

The initial ID was 1.80 (at a development contrast potential of 240 V), and the charge amount was 4.2 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.5.

Also, no filming to the photoreceptor was found, and high-quality halftone images having no blotches were obtained.

Furthermore, images were transferred onto OHP sheets, and the transmittance was measured and found to be as high as 71%.

When evaluation was performed in a 30° C.-85%RH environment, the ID was 1.82 (development contrast potential=180 V), and the charge amount was 3.6 by Q/d. In a 10° C.-20%RH environment, the ID was 1.80 (development contrast potential=320 V), and the charge amount was 4.5 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

(4) Formation of Black Developing Agent 88 parts by weight of a polyester resin identical with that of the magenta developing agent, 5 parts by weight of carbon black as a black pigment, 6 parts by weight of the LAX-N-100A rice wax (available from NS Chemical Limited Responsibility Company: melting point=79° C., kinematic viscosity at 100° C.=18 cSt), and 1 part by weight of TN-105 (a salicylic acid derivative zirconium complex manufactured by Hodogaya Chemical Co., Ltd.) as a CCA were uniformly mixed by a Henschel mixer, kneaded by the PCM45 biaxial extruder, cooled, and pulverized. The resultant material was further finely pulverized by a jet pulverizer. The fine powder was cut by an air classification machine to obtain magenta toner particles having a 50%-volume particle size of 8.0 μmg. 100 parts by weight of the obtained black toner particles, 2 parts by weight of a fine silica powder (NAX50 hydrophobic silica available from Nippon Aerozyl: BET specific surface area=40 $m^2/g$), 1 part by weight of a fine titanium oxide powder (STT-30A manufactured by Titan Kogyo K.K.), and 0.5 parts by weight of zinc stearate (grain size=4 μm) were mixed by a Henschel mixer for 3 min. The mixture was screened through a 200-mesh screen to obtain negatively chargeable black toner.

The obtained magenta toner was mixed with a carrier following the same procedures as for the magenta developing agent, thereby forming a black developing agent.

The obtained black developing agent was evaluated in the same manner as for the magenta developing agent. The initial ID was 1.81 (at a development contrast potential of 250 V), and the charge amount was 4.2 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.6.

Also, no filming to the photoreceptor was found, and high-quality halftone images having no blotches were obtained.

When evaluation was performed in a 30° C.-85%RH environment, the ID was 1.81 (development contrast potential=210 V), and the charge amount was 3.8 by Q/d. In a 10° C.-20%RH environment, the ID was 1.80 (development contrast potential=280 V), and the charge amount was 4.4 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

Formation of Color Images

Image formation was performed by using the magenta, yellow, cyan, and black developing agents obtained as described above in four developing devices of an image forming apparatus having the arrangement as shown in FIG. 1.

When images were taken, an automatic image quality maintaining mechanism was operated to perform automatic adjustment such that the maximum ID of each single color approached 1.8 within a possible range. With this standard, the maximum ID was held constant by controlling the development contrast, potential difference, and fog, and the halftone density was held constant by controlling the white potential difference.

Even after a paper feed test of 60,000 sheets was conducted, images satisfactory in both image density and fog were obtained, and toner scattering was also negligible.

Also, no filming to the photoreceptor was found, and high-quality halftone images having no blotches were obtained.

As described above, the output of each single color was stably obtained. Hence, when the obtained full-color images were evaluated, color reproducibility faithful to the originals were stably obtained throughout life. Also, clear full-color images having neither graininess nor noise such as blotches in halftone portions were obtained.

When OHP images were evaluated, each color showed satisfactory transparency and color generation.

When evaluation was performed in a 30° C.-85%RH environment, clear full-color images having color reproduction faithful to the originals, like images obtained at normal temperature and normal humidity, were obtained by compensating for the characteristic fluctuations of the developing agents by automatically controlling the process conditions.

Also in a 10° C.-20%RH environment, similar clear full-color images having color reproduction faithful to the originals were obtained.

Example 2

(1) Formation of Magenta Developing Agent

Propylene oxide and ethylene oxide adducts of bisphenol A as alcohol components and 50% of terephthalic acid and 50% of fumaric acid as acid components were polymerized to synthesize a polyester resin having an Mw of 17,000, an Mn of 4,000, an acid value of 5, a Tg of 61° C., and a softening point of 102° C.

The obtained polyester resin was used to form a masterbatch following the same procedures as in Example 1. After that, kneading, pulverization, classification, and mixture of additives were performed to form a magenta developing agent having a 50%-volume particle size of 8.0 μmg.

When this magenta developing agent was evaluated in the same manner as in Example 1, clear magenta images were obtained.

The initial ID was 1.80 (at a development contrast potential of 260 V), and the charge amount was 4.4 (measured by a femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible although it slightly increased. The charge amount after 60,000 sheets were copied was 3.3.

Also, no filming to the photoreceptor was found, and high-quality halftone images having no blotches were obtained.

Images were transferred onto OHP sheets, and the transmittance was measured and found to be as high as 75%.

When evaluation was performed in a 30° C.-85%RH environment, the ID was 1.82 (development contrast potential=170 V), and the charge amount was 3.3 by Q/d. In a 10° C.-20%RH environment, the ID was 1.80 (development contrast potential=300 V), and the charge amount was 4.6 by Q/d. In either environment, fog was of no problem at a white potential of 150 V.

After the obtained developing agent was placed in a polyethylene vessel and dipped into a constant temperature bath at 55° C. for 8 hr, almost no flocculation of toner was found, and the heat storage characteristic was also good.

(2) Formation of Yellow Developing Agent

A yellow developing agent was formed following the same procedures as for the magenta developing agent except that a Pigment Yellow 180 benzimidazolone pigment was used as a pigment.

When the obtained yellow developing agent was evaluated in the same manner as for the magenta developing agent, clear yellow images were obtained.

The initial ID was 1.79 (at a development contrast potential of 280 V), and the charge amount was 4.6 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.4.

Also, no filming to the photoreceptor was found, and high-quality halftone images having no blotches were obtained.

Images were transferred onto OHP sheets, and the transmittance was measured and found to be as high as 74%.

When evaluation was performed in a 30° C.-85%RH environment, the ID was 1.78 (development contrast potential=180 V), and the charge amount was 3.4 by Q/d. In a 10° C.-20%RH environment, the ID was 1.79 (development contrast potential=310 V), and the charge amount was 4.7 by Q/d. In either environment, fog was of no problem at a white potential of 150 V.

After this yellow developing agent was placed in a polyethylene vessel and dipped into a constant temperature bath at 55° C. for 8 hr, almost no flocculation of toner was found, and the heat storage characteristic was also good.

(3) Formation of Cyan Developing Agent

A cyan developing agent was formed following the same procedures as for the magenta developing agent except that a Pigment Blue 15:3 phthalocyanine pigment was used as a pigment and diluted by using 15 parts by weight of a masterbatch and 78 parts by weight of a polyester resin.

When the obtained cyan developing agent was evaluated in the same manner as for the magenta developing agent, clear cyan images were obtained.

The initial ID was 1.81 (at a development contrast potential of 250 V), and the charge amount was 4.3 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.3.

Also, no filming to the photoreceptor was found, and high-quality halftone images having no blotches were obtained.

Images were transferred onto OHP sheets, and the transmittance was measured and found to be as high as 73%.

When evaluation was performed in a 30° C.-85%RH environment, the ID was 1.83 (development contrast potential=170 V), and the charge amount was 3.3 by Q/d. In a 10° C.-20%RH environment, the ID was 1.82 (development contrast potential=320 V), and the charge amount was 4.6 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

(4) Formation of Black Developing Agent 88 parts by weight of a polyester resin identical with that of the magenta developing agent, 5 parts by weight of carbon black as a black pigment, 6 parts by weight of LAX-N-100A rice wax (available from NS Chemical Limited Responsibility Company: melting point=79° C., kinematic viscosity at 100° C.=18 cSt), and 1 part by weight of TN-105 (a salicylic acid derivative zirconium complex manufactured by Hodogaya Chemical Co., Ltd.) as a CCA were uniformly mixed by a Henschel mixer, kneaded by a PCM45 biaxial extruder, cooled, and pulverized. The resultant material was further finely pulverized by a jet pulverizer. The fine powder was cut by an air classification machine to obtain magenta toner particles having a 50%-volume particle size of 8.0 μmg.

100 parts by weight of the obtained black toner particles, 2 parts by weight of a fine silica powder (NAX50 hydrophobic silica available from Nippon Aerozyl: BET specific surface area=40 $m^2/g$), 1 part by weight of a fine titanium oxide powder (STT-30A manufactured by Titan Kogyo K.K.), and 0.5 parts by weight of zinc stearate (grain size=4 μm) were mixed by a Henschel mixer for 3 min. The mixture was screened through a 200-mesh screen to obtain negatively chargeable black toner.

The obtained magenta toner was mixed with a carrier following the same procedures as for the magenta developing agent, thereby forming a black developing agent.

The initial ID was 1.80 (at a development contrast potential of 250 V), and the charge amount was 4.3 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.5.

Also, no filming to the photoreceptor was found, and high-quality halftone images having no blotches were obtained.

When evaluation was performed in a 30° C.-85%RH environment, the ID was 1.80 (development contrast potential=180 V), and the charge amount was 3.6 by Q/d. In a 10° C.-20%RH environment, the ID was 1.79 (development contrast potential=300 V), and the charge amount was 4.5 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

Formation of Color Images

Following the same procedures as in Example 1, image formation was performed by using the magenta, yellow, cyan, and black developing agents obtained as described above in four developing devices of an image forming apparatus having the arrangement as shown in FIG. 1.

Even after a paper feed test of 60,000 sheets was conducted, images satisfactory in both image density and fog were obtained, and toner scattering was also negligible.

Also, no filming to the photoreceptor was found, and high-quality halftone images having no blotches were obtained.

When the obtained images were evaluated, color reproducibility faithful to originals were stably obtained throughout life and in a 30° C.-85%RH environment and a 10° C.-20%RH environment. Also, clear full-color images having neither graininess nor noise such as blotches in halftone portions were obtained.

When OHP images were evaluated, each color showed satisfactory transparency and color generation.

Comparative Example 1

(1) Formation of Magenta Developing Agent

A propylene oxide adduct of bisphenol A as an alcohol component and fumaric acid as an acid component were polymerized to synthesize a polyester resin having an Mw of 15,000, an Mn of 4,000, an acid value of 10, a Tg of 58° C., and a softening point of 103° C.

The obtained polyester resin was used to form a masterbatch following the same procedures as in Example 1. After that, kneading, pulverization, classification, and mixture of additives were performed to form a magenta developing agent having a 50%-volume particle size of 8.0 μmg.

When this magenta developing agent was evaluated in the same manner as in Example 1, clear magenta images were obtained.

The initial ID was 1.82 (at a development contrast potential of 270 V), and the charge amount was 4.6 (measured by a femto-C/10 μm E-Spart analyzer manufactured by HOSOKAWA MICRON CORP.) by Q/d. Vertical and horizontal lines were slightly conspicuous in solid portions.

After a paper feed test of 60,000 sheets was conducted, the image density was satisfactory, but both fog and toner scattering increased. The charge amount after 60,000 sheets were copied was 2.8.

Also, no filming to the photoreceptor was found, and halftone images had no problem such as blotches.

Images were transferred onto OHP sheets, and the transmittance was measured and found to be as high as 75%.

When evaluation was performed in a 30° C.-85%RH environment, the ID was 1.83 (development contrast potential=160 V), the charge amount was 2.9 by Q/d, and fog increased. In a 10° C.-20%RH environment, the ID was 1.81 (development contrast potential=300 V), and the charge amount was 4.6 by Q/d. Fog was of no problem at a white potential of 150 V.

After the obtained developing agent was placed in a polyethylene vessel and dipped into a constant temperature bath at 55° C. for 8 hr, almost no flocculation of toner was found, and the heat storage characteristic was also good.

(2) Formation of Yellow Developing Agent

A yellow developing agent was formed following the same procedures as for the magenta developing agent except that a Pigment Yellow 180 benzimidazolone pigment was used as a pigment.

When the obtained yellow developing agent was evaluated in the same manner as for the magenta developing agent, clear yellow images were obtained.

The initial ID was 1.81 (at a development contrast potential of 280 V), and the charge amount was 4.7 (measured by the Femuto C/10-μm E-Spart analyzer manufactured by HOSOKAWA MICRON CORP.) by Q/d.

In solid portions, vertical and horizontal lines were more or less found as in the case of the magenta developing agent.

After a paper feed test of 60,000 sheets was conducted, the image density was satisfactory, but both fog and toner scattering increased. The charge amount after 60,000 sheets were copied was 2.7.

Also, no filming to the photoreceptor was found, and high-quality halftone images having no blotches were obtained.

Images were transferred onto OHP sheets, and the transmittance was measured and found to be as high as 75%.

When evaluation was performed in a 30° C.-85%RH environment, the ID was 1.80 (development contrast potential=160 V), the charge amount was 2.9 by Q/d, and fog increased. In a 10° C.-20%RH environment, the ID was 1.79 (development contrast potential=300 V), and the charge amount was 4.7 by Q/d. Fog was of no problem at a white potential of 150 V.

After this yellow developing agent was placed in a polyethylene vessel and dipped into a constant temperature bath at 55° C. for 8 hr, almost no flocculation of toner was found, and the heat storage characteristic was also good.

(3) Formation of Cyan Developing Agent

A cyan developing agent was formed following the same procedures as for the magenta developing agent except that a Pigment Blue 15:3 phthalocyanine pigment was used as a pigment and diluted by using 15 parts by weight of a masterbatch and 78 parts by weight of a polyester resin.

When the obtained cyan developing agent was evaluated in the same manner as for the magenta developing agent, clear cyan images were obtained.

The initial ID was 1.81 (at a development contrast potential of 260 V), and the charge amount was 4.5 (measured by the femto-C/10 μm E-Spart analyzer manufactured by HOSOKAWA MICRON CORP.) by Q/d.

In solid portions, vertical and horizontal lines were more or less found.

After a paper feed test of 60,000 sheets was conducted, the image density was satisfactory, but both fog and toner scattering increased. The charge amount after 60,000 sheets were copied was 2.7.

Also, no filming to the photoreceptor was found, and high-quality halftone images having no blotches were obtained.

Images were transferred onto OHP sheets, and the transmittance was measured and found to be as high as 73%.

When evaluation was performed in a 30° C.-85%RH environment, the ID was 1.83 (development contrast potential=170 V), the charge amount was 3.0 by Q/d, and fog increased. In a 10° C.-20%RH environment, the ID was 1.83 (development contrast potential=300 V), and the charge amount was 4.6 by Q/d. Fog was of no problem at a white potential of 150 V.

After the obtained developing agent was placed in a polyethylene vessel and dipped into a constant temperature bath at 55° C. for 8 hr, almost no flocculation was found, and the heat storage characteristic was also good.

(4) Formation of Black Developing Agent 88 parts by weight of a polyester resin identical with that of the magenta developing agent of Comparative Example 1, 5 parts by weight of carbon black as a black pigment, 6 parts by weight of LAX-N-100A rice wax (available from NS Chemical Limited Responsibility Company: melting point=79° C., kinematic viscosity at 100° C.=18 cSt), and 1 part by weight of TN-105 (a salicylic acid derivative zirconium complex manufactured by Hodogaya Chemical Co., Ltd.) as a CCA were uniformly mixed by a Henschel mixer, kneaded by a PCM45 biaxial extruder, cooled, and pulverized. The resultant material was further finely pulverized by a jet pulverizer. The fine powder was cut by an air classification machine to obtain magenta toner particles having a 50%-volume particle size of 8.0 μm. 100 parts by weight of the obtained black toner particles, 2 parts by weight of a fine silica powder (NAX50 hydrophobic silica available from Nippon Aerozyl: BET specific surface area=40 $m^2/g$), 1 part by weight of a fine titanium oxide powder (STT-30A manufactured by Titan Kogyo K.K.), and 0.5 parts by weight of zinc stearate (grain size=4 μm) were mixed by a Henschel mixer for 3 min. The mixture was screened through a 200-mesh screen to obtain negatively chargeable black toner.

The obtained magenta toner was mixed with a carrier following the same procedures as for the magenta developing agent, thereby forming a black developing agent.

The initial ID was 1.79 (at a development contrast potential of 260 V), and the charge amount was 4.5 (measured by the femto-C/10 μm E-Spart analyzer manufactured by HOSOKAWA MICRON CORP.) by Q/d. In solid portions, vertical and horizontal lines were more or less found.

After a paper feed test of 60,000 sheets was conducted, the image density was satisfactory, but both fog and toner scattering increased. The charge amount after 60,000 sheets were copied was 3.0.

Also, no filming to the photoreceptor was found, and high-quality halftone images having no blotches were obtained.

When evaluation was performed in a 30° C.-85%RH environment, the ID was 1.80 (development contrast potential=190 V), and the charge amount was 3.4 by Q/d. In a 10° C.-20%RH environment, the ID was 1.80 (development contrast potential=300 V), and the charge amount was 4.5 by Q/d. In either environment, fog was of no problem at a white potential of 150 V.

After the obtained developing agent was placed in a polyethylene vessel and dipped into a constant temperature bath at 55° C. for 8 hr, almost no flocculation of toner was found, and the heat storage characteristic was also good.

Formation of Color Images

Following the same procedures as in Example 1, image formation was performed by using the magenta, yellow, cyan, and black developing agents obtained as described above in four developing devices of an image forming apparatus having the arrangement as shown in FIG. 1.

After a paper feed test of 60,000 sheets was conducted, although the image density was maintained, fog increased, and toner scattering also increased and fallen toner particles appeared as noise.

Also, no filming to the photoreceptor was found, and high-quality halftone images having no blotches were obtained.

When the color reproducibility of the obtained images was examined, each color exhibited a steep y characteristic throughout life, so the color became darker than the original. Also, dots became big to deteriorate the graininess of halftone portions.

When images were transferred onto OHP sheets and evaluated, each color showed satisfactory transparency and color generation.

When evaluation was performed in a 30° C.-85%RH environment, fog increased as a whole, the color reproducibility shifted to darker colors, and the graininess suffered.

In a 10° C.-20%RH environment, although vertical and horizontal lines in solid portions were slightly conspicuous, the color reproducibility, fog, and graininess were preferable as a whole.

Comparative Example 2

(1) Formation of Magenta Developing Agent

A masterbatch was formed following the same procedures as in Example 1 except that a Pigment Red 57:1 azolake pigment was used as a pigment. After that, kneading, pulverization, classification, and addition were performed to form a magenta developing agent having a 50%-volume particle size of 8.0 μmg.

When this magenta developing agent was evaluated in the same manner as in Example 1, clear magenta images were obtained.

The initial ID was 1.80 (at a development contrast potential of 300 V), and the charge amount was 4.6 (measured by a femto-C/10 μm E-Spart analyzer manufactured by HOSOKAWA MICRON CORP.) by Q/d.

After a paper feed test of 60,000 sheets was conducted, the image density lowered, and both fog and toner scattering increased. The charge amount after 60,000 sheets were copied was 5.4.

Also, no filming to the photoreceptor was found, and halftone images had no problem such as blotches.

Images were transferred onto OHP sheets, and the transmittance was measured and found to be as high as 72%.

When evaluation was performed in a 30° C.-85%RH environment, the ID was 1.84 (development contrast potential=150 V), the charge amount was 2.6 by Q/d, and fog increased.

In a 10° C.-20%RH environment, the ID was as low as 1.50 (development contrast potential=350 V), and the charge amount was 5.3 by Q/d. Fog was favorable at a white potential of 150 V.

After the obtained developing agent was placed in a polyethylene vessel and dipped into a constant temperature bath at 55° C. for 8 hr, almost no flocculation of toner was found, and the heat storage characteristic was also good.

(2) Formation of Yellow Developing Agent

A yellow developing agent was formed following the same procedures as in Example 1 except that a Pigment Yellow 97 monoazo pigment was used as a yellow pigment and that the amount of the obtained masterbatch was 30 parts by weight and the amount of a polyester resin to be mixed in the masterbatch was 63 parts by weight.

When the obtained yellow developing agent was evaluated in the same manner as for the magenta developing agent, clear yellow images were obtained.

The initial ID was 1.79 (at a development contrast potential of 280 V), and the charge amount was 4.5 (measured by the femto-C/10 μm E-Spart analyzer manufactured by HOSOKAWA MICRON CORP.) by Q/d.

After a paper feed test of 60,000 sheets was conducted, the image density was maintained, but both fog and toner scattering increased. The charge amount after 60,000 sheets were copied was 2.9.

Also, no filming to the photoreceptor was found, and halftone images had no problem such as blotches.

Images were transferred onto OHP sheets, and the transmittance was measured and found to be 62%. That is, the transmittance and color generation were unsatisfactory.

When evaluation was performed in a 30° C.-85%RH environment, the ID was 1.82 (development contrast potential=170 V), the charge amount was 2.9 by Q/d, and fog increased.

In a 10° C.-20%RH environment, the ID was 1.75 (development contrast potential=350 V), and the charge amount was 4.8 by Q/d. Fog was of no problem at a white potential of 150 V.

After this yellow developing agent was placed in a polyethylene vessel and dipped into a constant temperature bath at 55° C. for 8 hr, almost no flocculation of toner was found, and the heat storage characteristic was also good.

(3) Formation of Cyan Developing Agent

A cyan developing agent identical with that of Example 1 was used.

(4) Formation of Black Developing Agent

A black developing agent identical with that of Example 1 was used.

Formation of Color Images

Following the same procedures as in Example 1, image formation was performed by using the magenta, yellow, cyan, and black developing agents obtained as described above in four developing devices of an image forming apparatus having the arrangement as shown in FIG. 1.

After a paper feed test of 60,000 sheets was conducted, the image density of magenta lowered, and background fog reddish as a whole was produced. Also, toner scattering increased and fallen toner particles appeared as noise on images.

No filming to the photoreceptor was found, and high-quality halftone images having no blotches were obtained.

When the color reproducibility of the obtained images was examined, the color reproducibility was initially faithful to the originals, but the images became greenish with life. Although the color balance was manually adjusted, only low image density was obtained as a whole.

When images were transferred onto OHP sheets and evaluated, the yellow transmittance was low, so images were dark in that portion.

When evaluation was performed in a 30° C.-85%RH environment, magenta was strong in the obtained images, and a large amount of reddish background fog was produced.

In a 10° C.-20%RH environment, greenish images were formed, so the color reproducibility was unsatisfactory.

Example 3

(1) Formation of Magenta Developing Agent

A magenta developing agent was obtained following the same procedures as in Example 1 except that the amount of a salicylic acid derivative zirconium complex as a CCA was 0.5 parts by weight.

When this magenta developing agent was evaluated in the same manner as in Example 1, clear magenta images were obtained.

The initial ID was 1.81 (at a development contrast potential of 240 V), and the charge amount was 4.1 (measured by a femto-C/10 $\mu$m E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible although it slightly increased. The charge amount after 60,000 sheets were copied was 3.2.

Also, no filming to the photoreceptor was found, and high-quality halftone images having no blotches were obtained.

Images were transferred onto OHP sheets, and the transmittance was measured and found to be as high as 73%.

When evaluation was performed in a 30° C.-85%RH environment, the ID was 1.83 (development contrast potential=170 V), and the charge amount was 3.2 by Q/d.

In a 10° C.-20%RH environment, the ID was 1.79 (development contrast potential=300 V), and the charge amount was 4.6 by Q/d. In either environment, fog was of no problem at a white potential of 150 V.

After the obtained developing agent was placed in a polyethylene vessel and dipped into a constant temperature bath at 55° C. for 8 hr, almost no flocculation of toner was found, and the heat storage characteristic was also good.

(2) Formation of Yellow Developing Agent

A yellow developing agent was formed following the same procedures as for the magenta developing agent except that a Pigment Yellow 180 benzimidazolone pigment was used as a pigment.

When the obtained yellow developing agent was evaluated in the same manner as for the magenta developing agent, clear yellow images were obtained.

The initial ID was 1.78 (at a development contrast potential of 250 V), and the charge amount was 4.4 (measured by the femto-C/10 $\mu$m E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.4.

Also, no filming to the photoreceptor was found, and high-quality halftone images having no blotches were obtained.

Images were transferred onto OHP sheets, and the transmittance was measured and found to be as high as 74%.

When evaluation was performed in a 30° C.-85%RH environment, the ID was 1.78 (development contrast potential=170 V), and the charge amount was 3.3 by Q/d. In a 10° C.-20%RH environment, the ID was 1.80 (development contrast potential=300 V), and the charge amount was 4.6 by Q/d. In either environment, fog was of no problem at a white potential of 150 V.

After this yellow developing agent was placed in a polyethylene vessel and dipped into a constant temperature bath at 55° C. for 8 hr, almost no flocculation of toner was found, and the heat storage characteristic was also good.

(3) Formation of Cyan Developing Agent

A cyan developing agent was formed following the same procedures as for the magenta developing agent except that a Pigment Blue 15:3 phthalocyanine pigment was used as a pigment and diluted by using 15 parts by weight of a masterbatch and 78 parts by weight of a polyester resin.

When the obtained cyan developing agent was evaluated in the same manner as for the magenta developing agent, clear cyan images were obtained.

The initial ID was 1.81 (at a development contrast potential of 240 V), and the charge amount was 4.1 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.3.

Also, no filming to the photoreceptor was found, and high-quality halftone images having no blotches were obtained.

Images were transferred onto OHP sheets, and the transmittance was measured and found to be as high as 72%.

When evaluation was performed in a 30° C.-85%RH environment, the ID was 1.84 (development contrast potential=180 V), and the charge amount was 3.5 by Q/d. In a 10° C.-20%RH environment, the ID was 1.83 (development contrast potential=300 V), and the charge amount was 4.5 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

(4) Formation of Black Developing Agent

A black developing agent was formed following the same procedures as in Example 1 except that the amount of a salicylic acid derivative zirconium complex as a CCA was 0.5 parts by weight.

The initial ID was 1.84 (at a development contrast potential of 250 V), and the charge amount was 4.2 (measured by the femto-C/10 μm E-Spart analyzer manufactured by HOSOKAWA MICRON CORP.) by Q/d.

Even after a paper feed test of 60,000 sheets was conducted, images satisfactory in both image density and fog were obtained, and toner scattering was also negligible. The charge amount after 60,000 sheets were copied was 3.3.

Also, no filming to the photoreceptor was found, and high-quality halftone images having no blotches were obtained.

When evaluation was performed in a 30° C.-85%RH environment, the ID was 1.83 (development contrast potential=200 V), and the charge amount was 3.7 by Q/d. In a 10° C.-20%RH environment, the ID was 1.78 (development contrast potential=270 V), and the charge amount was 4.3 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

Formation of Color Images

Following the same procedures as in Example 1, image formation was performed by using the magenta, yellow, cyan, and black developing agents obtained as described above in four developing devices of an image forming apparatus having the arrangement as shown in FIG. 1.

Even after a paper feed test of 60,000 sheets was conducted, images satisfactory in both image density and fog were obtained, and toner scattering was also negligible.

Also, no filming to the photoreceptor was found, and high-quality halftone images having no blotches were obtained.

When the color reproducibility of the obtained images was examined, color reproduction faithful to the originals were obtained throughout life and in a 30° C.-85%RH environment. Also, clear full-color images having little graininess and noise such as blotches in halftone portions were obtained.

When images were transferred onto OHP sheets and evaluated, each color showed satisfactory transparency and color generation.

Comparative Example 3

(1) Formation of Magenta Developing Agent

A magenta developing agent was obtained following the same procedures as in Example 1 except that 1 part by weight of a salicylic acid derivative zinc complex (E-84 manufactured by Orient Kagaku) was used instead of a salicylic acid derivative zirconium complex as a CCA.

When the obtained developing agent was evaluated in the same manner as in Example 1, clear magenta images were obtained.

The initial ID was 1.83 (at a development contrast potential of 230 V), and the charge amount was 4.0 (measured by a femto-C/10 μm E-Spart analyzer manufactured by HOSOKAWA MICRON CORP.) by Q/d.

After a paper feed test of 60,000 sheets was conducted, the image density was maintained, but both fog and toner scattering increased. The charge amount after 60,000 sheets were copied was 2.2.

Also, no filming to the photoreceptor was found, and halftone images had no problem such as blotches.

Images were transferred onto OHP sheets, and the transmittance was measured and found to be as high as 73%.

When evaluation was performed in a 30° C.-85%RH environment, the ID was 1.86 (development contrast potential=150 V), the charge amount was 2.2 by Q/d, and fog increased.

In a 10° C.-20%RH environment, the ID was 1.80 (development contrast potential=300 V), and the charge amount was 4.6 by Q/d. Fog was of no problem at a white potential of 150 V.

After the obtained developing agent was placed in a polyethylene vessel and dipped into a constant temperature bath at 55° C. for 8 hr, almost no flocculation of toner was found, and the heat storage characteristic was also good.

(2) Formation of Yellow Developing Agent

A yellow developing agent was formed following the same procedures as for the magenta developing agent except that a Pigment Yellow 180 benzimidazolone pigment was used as a pigment.

When the obtained yellow developing agent was evaluated in the same manner as for the magenta developing agent, clear yellow images were obtained.

The initial ID was 1.81 (at a development contrast potential of 230 V), and the charge amount was 4.0 (measured by the femto-C/10 μm E-Spart analyzer manufactured by HOSOKAWA MICRON CORP.) by Q/d.

After a paper feed test of 60,000 sheets was conducted, the image density was maintained, but both fog and toner scattering increased. The charge amount after 60,000 sheets were copied was 2.4.

Also, no filming to the photoreceptor was found, and high-quality halftone images having no blotches were obtained.

Images were transferred onto OHP sheets, and the transmittance was measured and found to be as high as 74%.

When evaluation was performed in a 30° C.-85%RH environment, the ID was 1.84 (development contrast potential=150 V), and the charge amount was 2.3 by Q/d. In a 10° C.-20%RH environment, the ID was 1.81 (development contrast potential=300 V), and the charge amount was 4.6 by Q/d. In either environment, fog was of no problem at a white potential of 150 V.

After this yellow developing agent was placed in a polyethylene vessel and dipped into a constant temperature bath at 55° C. for 8 hr, almost no flocculation of toner was found, and the heat storage characteristic was also good.

(3) Formation of Cyan Developing Agent

A cyan developing agent was formed following the same procedures as for the magenta developing agent except that a Pigment Blue 15:3 phthalocyanine pigment was used as a pigment and diluted by using 15 parts by weight of a masterbatch and 78 parts by weight of a polyester resin.

When the obtained cyan developing agent was evaluated in the same manner as for the magenta developing agent, clear cyan images were obtained.

The initial ID was 1.84 (at a development contrast potential of 230 V), and the charge amount was 3.9 (measured by the femto-C/10 μm E-Spart analyzer manufactured by HOSOKAWA MICRON CORP.) by Q/d.

After a paper feed test of 60,000 sheets was conducted, the image density was maintained, but both fog and toner scattering increased. The charge amount after 60,000 sheets were copied was 2.4.

Also, no filming to the photoreceptor was found, and high-quality halftone images having no blotches were obtained.

Images were transferred onto OHP sheets, and the transmittance was measured and found to be as high as 72%.

When evaluation was performed in a 30° C.-85%RH environment, the ID was 1.83 (development contrast potential=160 V), and the charge amount was 2.5 by Q/d. In a 10° C.-20%RH environment, the ID was 1.82 (development contrast potential=300 V), and the charge amount was 4.5 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

(4) Formation of Black Developing Agent

A black developing agent was formed following the same procedures as in Example 1 except that a CCA was changed to 1 part by weight of a salicylic acid derivative zinc complex (E-84 manufactured by Orient Kagaku).

The initial ID was 1.85 (at a development contrast potential of 230 V), and the charge amount was 4.0 (measured by the femto-C/10 μm E-Spart analyzer manufactured by HOSOKAWA MICRON CORP.) by Q/d.

After a paper feed test of 60,000 sheets was conducted, the image density was maintained, but both fog and toner scattering increased. The charge amount after 60,000 sheets were copied was 2.5.

Also, no filming to the photoreceptor was found, and high-quality halftone images having no blotches were obtained.

When evaluation was performed in a 30° C.-85%RH environment, the ID was 1.80 (development contrast potential=170 V), and the charge amount was 3.2 by Q/d. In a 10° C.-20%RH environment, the ID was 1.81 (development contrast potential=300 V), and the charge amount was 4.6 by Q/d. In either environment, fog was of no problem at a white potential of 150 V.

After the obtained developing agent was placed in a polyethylene vessel and dipped into a constant temperature bath at 55° C. for 8 hr, almost no flocculation of the developing agent was found, and the heat storage characteristic was also good.

Formation of Color Images

Following the same procedures as in Example 1, image formation was performed by using the magenta, yellow, cyan, and black developing agents obtained as described above in four developing devices of an image forming apparatus having the arrangement as shown in FIG. 1.

After a paper feed test of 60,000 sheets was conducted, although the image density was maintained, background fog blackish as a whole was produced, and toner scattering increased and fallen toner particles appeared as noise on images.

Also, no filming to the photoreceptor was found, and high-quality halftone images having no blotches were obtained.

When the color reproducibility of the obtained images were examined, each color exhibited a steep y characteristic throughout life, so the color became darker than the original. Also, dots became big to deteriorate the graininess of halftone portions.

When images were transferred onto OHP sheets and evaluated, each color showed satisfactory transparency and color generation.

When evaluation was performed in a 30° C.-85%RH environment, fog increased as a whole, the color reproducibility shifted to darker colors, and the graininess suffered.

In a 10° C.-20%RH environment, images satisfactory in color reproducibility, fog, and graininess were obtained.

Table 2 below shows the results obtained for Examples 1 to 3 and Comparative Examples 1 to 3.

TABLE 2

| | List of Results of Examples | | | | | |
|---|---|---|---|---|---|---|
| Sample | N/N charge amount | H/H charge amount | Life ID | Fog scattering | Life Q change | OHP transparency |
| Example 1 | | | | | | |
| Magenta PR184 | 4.3 | 3.5 | ○ | ○ | ○ | ○ |
| Yellow PY180 | 4.4 | 3.6 | ○ | ○ | ○ | ○ |

TABLE 2-continued

List of Results of Examples

| Sample | N/N charge amount | H/H charge amount | Life ID | Fog scatter-ing | Life Q change | OHP transpar-ency |
|---|---|---|---|---|---|---|
| Cyan PB15:3 | 4.2 | 3.6 | ○ | ○ | ○ | ○ |
| Black carbon black | 4.2 | 3.8 | ○ | ○ | ○ | — |
| Example 2 | | | | | | |
| Magenta acid value 5 | 4.4 | 3.3 | ○ | ○ | ○ | ○ |
| Yellow acid value 5 | 4.6 | 3.4 | ○ | ○ | ○ | ○ |
| Cyan acid value 5 | 4.3 | 3.3 | ○ | ○ | ○ | ○ |
| Black acid value 5 | 4.3 | 3.6 | ○ | ○ | ○ | — |
| Comparative Example 1 | | | | | | |
| Magenta acid value 10 | 4.6 | 2.9 | ○ | X | X | ○ |
| Yellow acid value 10 | 4.7 | 2.9 | ○ | X | X | ○ |
| Cyan acid value 10 | 4.5 | 3.0 | ○ | X | X | ○ |
| Black acid value 10 | 4.5 | 3.4 | ○ | X | X | — |
| Comparative Example 2 | | | | | | |
| Magenta PR57:1 | 4.6 | 2.6 | X | X | X | ○ |
| Yellow PY97 | 4.5 | 2.9 | ○ | Δ | Δ | X |
| Cyan PB15:3 | 4.2 | 3.6 | ○ | ○ | ○ | ○ |
| Black carbon black | 4.2 | 3.8 | ○ | ○ | ○ | — |
| Example 3 | | | | | | |
| Magenta CCA amount 0.5% | 4.1 | 3.2 | ○ | ○ | ○ | ○ |
| Yellow CCA amount 0.5% | 4.4 | 3.3 | ○ | ○ | ○ | ○ |
| Cyan CCA amount 0.5% | 4.1 | 3.5 | ○ | ○ | ○ | ○ |
| Black CCA amount 0.5% | 4.2 | 3.7 | ○ | ○ | ○ | ○ |
| Comparative Example 3 | | | | | | |
| Magenta CCA E-84 | 4.0 | 2.2 | ○ | X | X | ○ |
| Yellow CCA E-84 | 4.0 | 2.3 | ○ | X | X | ○ |
| Cyan CCA E-84 | 3.9 | 2.5 | ○ | X | X | ○ |
| Black CCA E-84 | 4.0 | 3.2 | ○ | X | X | — |

Table 2 above indicates that when, as in Examples 1 to 3, image formation was performed using the developing agents having the compositions according to the present invention, the charging characteristics were stable against environmental changes and throughout life, fog and toner scattering were well suppressed, and images having satisfactory image density and excellent color tones were formed. However, when a polyester resin having a high acid value was used as in Comparative Example 1, the smoothness of images suffered, fog and toner scattering occurred throughout life, and the charging characteristics became unstable. Also, when pigments outside the range of the present invention were used as colorants as in Comparative Example 2, the image density lowered and fog and toner scattering occurred throughout life, the charging characteristics became unstable, and the transparency lowered. Furthermore, when a charge control agent outside the range of the present invention was used as in Comparative Example 3, fog and toner scattering occurred throughout life, and the charging characteristics became unstable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

first to fourth image carriers;

first to fourth developing devices opposing said first to fourth image carriers in one-to-one correspondence with each other to develop first to fourth electrostatic latent images, formed on said first to fourth image carriers, by using first to fourth developing agents, thereby forming first to fourth developing agent images, first to fourth transfer devices, arranged after said first to fourth developing devices in one-to-one correspondence with each other, for transferring the first to fourth developing agent images onto a transfer medium; and a fixing device for fixing the transferred first to fourth developing agent images on the transfer medium, wherein as each of the first to fourth developing agents, one of a yellow developing agent comprising a yellow toner particle and zinc stearate mixed with the yellow toner particle, said yellow toner particle containing a polyester resin having an acid value of not more than 6, a zirconium complex of a salicylic acid derivative, and a benzimidazolone pigment as a yellow pigment, a magenta developing agent comprising a magenta toner particle and zinc stearate mixed with the magenta toner particle, said magenta toner particle containing a polyester resin having an acid value of not more than 6, a zirconium complex of a salicylic acid derivative, and a naphthol AS insoluble azo pigment as a magenta pigment, a cyan developing agent comprising a cyan toner particle and zinc stearate mixed with the cyan toner particle, said cyan toner particle containing a polyester resin having an acid value of not more than 6, a zirconium complex of a salicylic acid derivative, and a phthalocyanine pigment as a cyan pigment, and a black developing agent comprising a black toner particle and zinc stearate mixed with the black toner particle, said black toner particle containing a polyester resin having an acid value of not more than 6, a zirconium complex of a salicylic acid derivative, and carbon black as a black pigment is applied;

wherein development γ characteristics of said first to fourth developing agents are substantially equal; and wherein said first to fourth developing agents are located in the respective first to fourth developing devices.

2. An apparatus according to claim 1, wherein the benzimidazolone pigment is Pigment Yellow 180, the naphthol AS insoluble pigment is Pigment Red 184, and the phthalocyanine pigment is Pigment Blue 15:3.

3. An apparatus according to claim 1, wherein at least one of said first to fourth developing agents further comprises wax.

4. An apparatus according to claim 1, wherein silica is added to said first to fourth developing agent.

5. An image forming method comprising:

the development/transfer step of developing first to fourth electrostatic latent images, formed on first to fourth image carriers, by using first to fourth developing agents having different colors, thereby forming first to fourth developing agent images, and sequentially transferring the first to fourth developing agent images onto a transfer medium; and the fixing step of fixing the transferred first to fourth developing agent images on the transfer medium, wherein as each of the first to fourth developing agents, one of a yellow developing agent comprising a yellow toner particle and zinc stearate mixed with the yellow toner particle, said yellow toner particle containing a polyester resin having an acid value of not more than 6, a zirconium complex of a salicylic acid derivative, and a benzimidazolone pigment as a yellow pigment, a magenta developing agent comprising a magenta toner particle and zinc stearate mixed with the magenta toner particle, said magenta toner particle containing a polyester resin having an acid value of not more than 6, a zirconium complex of a salicylic acid derivative, and a naphthol AS insoluble azo pigment as a magenta pigment, a cyan developing agent comprising a cyan toner particle and zinc stearate mixed with the cyan toner particle, said cyan toner particle containing a polyester resin having an acid value of not more than 6, a zirconium complex of a salicylic acid derivative, and a phthalocyanine pigment as a cyan pigment, and a black developing agent comprising a black toner particle and zinc stearate mixed with the black toner particle, said black toner particle containing a polyester resin having an acid value of not more than 6, a zirconium complex of a salicylic acid derivative, and carbon black as a black pigment is applied; and wherein development γ characteristics of said first to fourth developing agents are substantially equal.

6. A method according to claim 5, wherein the benzimidazolone pigment is Pigment yellow 180, the naphthol AS insoluble azo pigment is Pigment Red 1 84 and the phthalocyanine pigment is Pigment Blue 1 5:3.

7. A method according to claim 5, wherein at least one of said first to fourth developing agents further comprises wax.

8. A method according to claim 5, wherein silica is added to said first to fourth developing agent.

* * * * *